US006839929B2

(12) United States Patent
Stolpmann

(10) Patent No.: US 6,839,929 B2
(45) **Date of Patent: *Jan. 11, 2005**

(54) SELF-SEALING MATTRESS STRUCTURE

(75) Inventor: James R. Stolpmann, Lawrenceburg, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/044,410

(22) Filed: Jan. 10, 2002

(65) Prior Publication Data

US 2003/0110568 A1 Jun. 19, 2003

Related U.S. Application Data

(60) Provisional application No. 60/340,563, filed on Dec. 13, 2001.

(51) Int. Cl.[7] ..... A47C 27/10
(52) U.S. Cl. ..... 5/710; 5/712; 5/713; 5/706
(58) Field of Search ..... 5/710, 706, 712, 5/713

(56) References Cited

U.S. PATENT DOCUMENTS

| | | | | | |
|---|---|---|---|---|---|
| 371,938 | A | | 10/1887 | Hinsdill | |
| 779,576 | A | * | 1/1905 | Berryman | 5/710 |
| 1,307,825 | A | | 6/1919 | Marshall | |
| 1,746,709 | A | | 2/1930 | Marshall | |
| 2,018,548 | A | * | 10/1935 | Currey | 441/66 |
| 2,029,370 | A | | 2/1936 | Heldenbrand | |
| 2,039,289 | A | * | 5/1936 | Bergeron | 5/710 |
| 2,719,986 | A | | 10/1955 | Rand | |
| 2,823,394 | A | * | 2/1958 | Smith | 5/710 |
| 3,008,465 | A | | 11/1961 | Gal | |
| 3,148,391 | A | | 9/1964 | Whitney | |
| 3,268,922 | A | | 8/1966 | Moxley | |
| 3,512,190 | A | | 5/1970 | Buff | |
| 3,678,520 | A | | 7/1972 | Evans | |
| 3,867,732 | A | | 2/1975 | Morrell | |
| 3,974,532 | A | | 8/1976 | Ecchuya | |
| 4,086,675 | A | | 5/1978 | Talbert et al. | |
| 4,538,311 | A | * | 9/1985 | Hall et al. | 5/686 |
| 4,606,087 | A | | 8/1986 | Alivizatos | |
| 4,638,519 | A | | 1/1987 | Hess | |
| 4,679,264 | A | * | 7/1987 | Mollura | 5/710 |
| 4,682,378 | A | | 7/1987 | Savenije | |

(List continued on next page.)

*Primary Examiner*—Teri Pham Luu
(74) *Attorney, Agent, or Firm*—Bose McKinney & Evans LLP

(57) ABSTRACT

A mattress for a bed having a frame for supporting the mattress and side rails, includes a non-puncture resistant cover with an interior surface, and a core disposed adjacent the interior surface. The core includes a body defining a plurality of mounting locations, and further includes a plurality of self sealing gas containers that are respectively disposed within the plurality of mounting locations. Accordingly, the overall height of the mattress may be used by the gas containers since a puncture resistant foam layer is not necessary.

77 Claims, 4 Drawing Sheets

U.S. PATENT DOCUMENTS 4,689,844 A 9/1987 Alivizatos
4,706,313 A 11/1987 Murphy
4,803,744 A 2/1989 Peck et al.
4,896,389 A 1/1990 Chamberland
4,903,359 A 2/1990 Rogers
4,928,337 A 5/1990 Chauncey
4,930,173 A 6/1990 Woller
4,949,412 A 8/1990 Goode
4,975,996 A 12/1990 Evans et al.
5,002,336 A 3/1991 Feher
5,022,110 A 6/1991 Stroh
5,022,111 A 6/1991 Fenner, Sr.
5,025,519 A 6/1991 Spann et al.
5,029,352 A 7/1991 Hargest et al.
5,031,261 A 7/1991 Fenner, Sr.
5,036,559 A 8/1991 Hargest
5,044,027 A 9/1991 Moon
5,051,673 A 9/1991 Goodwin
5,090,077 A 2/1992 Caden et al.
5,111,544 A 5/1992 Graebe
5,182,826 A 2/1993 Thomas et al.
5,231,717 A 8/1993 Scott et al.
5,259,079 A 11/1993 Visser et al.
5,267,364 A 12/1993 Volk
5,311,623 A 5/1994 Hendi
5,323,500 A 6/1994 Roe et al.
5,325,551 A 7/1994 Tappel et al.
5,331,698 A 7/1994 Newkirk et al.
5,373,595 A 12/1994 Johnson et al.
5,375,273 A 12/1994 Bodine, Jr. et al.
5,394,576 A 3/1995 Soltani et al.
5,421,044 A * 6/1995 Steensen ..... 5/710
5,483,709 A 1/1996 Foster et al.
5,487,197 A 1/1996 Iskra, Jr. et al.
5,513,402 A 5/1996 Schwartz
5,542,136 A 8/1996 Tappel
5,586,346 A 12/1996 Stacy et al.
5,586,348 A * 12/1996 Toivio et al. ..... 5/710
5,588,167 A 12/1996 Pahno et al.
5,594,963 A 1/1997 Berkowitz
5,611,096 A 3/1997 Bartlett et al.
5,617,595 A 4/1997 Landi et al.
5,621,934 A * 4/1997 Olkkonen et al. ..... 5/710
5,623,736 A 4/1997 Soltani et al.
5,634,224 A * 6/1997 Gates ..... 5/709
5,634,225 A * 6/1997 Miller et al. ..... 5/710
5,638,564 A 6/1997 Greenawalt et al.
5,647,079 A 7/1997 Hakamiun et al.
5,666,681 A 9/1997 Meyer et al.
5,680,662 A 10/1997 Purdy et al.
5,701,622 A * 12/1997 Biggie et al. ..... 5/713
5,781,949 A 7/1998 Weismiller et al.
5,802,646 A 9/1998 Stolpmann et al.
5,904,172 A 5/1999 Gifft et al.
5,920,934 A 7/1999 Hannagan et al.
5,966,762 A 10/1999 Wu
6,115,861 A 9/2000 Reeder et al.
6,212,718 B1 4/2001 Stolpmann et al.
6,286,167 B1 9/2001 Stolpmann
6,401,277 B1 * 6/2002 Savage et al. ..... 5/430
6,401,281 B1 * 6/2002 Younge ..... 5/663
6,453,490 B1 * 9/2002 Cardinale ..... 5/426

* cited by examiner

SELF-SEALING MATTRESS STRUCTURE

This application claims benefit of provisional application No. 60/340,563 filed Dec. 13, 2001.

FIELD OF THE INVENTION

The present invention generally relates to a mattress structure, and more particularly to a mattress structure for hospital beds having a core with a plurality of self-sealing gas enclosures.

BACKGROUND OF THE INVENTION

Mattress support structures for health care applications, such as hospital beds, are generally provided with a mattress having air cushions. It is desirable to provide a mattress with air cushions that are as thick or tall as possible to provide maximum comfort and maximum mattress performance. The height of conventional air mattress are limited, however, by regulatory requirements relating to the minimum bed siderail height above the sleep surface of the mattress. In typical applications, the bed siderail height regulations effectively limit the overall mattress height to approximately six inches. A portion of this overall mattress height is used by a layer of foam or similar material placed on top of the air cushions. In health care settings, the use of sharp objects such as needles is common. As such, the mattress foam layer is desirable to protect the mattress air cushions from needle punctures and the consequent air loss of air cushions incorporated into the mattress.

Generally, the foam layer of conventional mattresses is approximately three inches thick, thereby reducing the maximum height of the air cushions to approximately three inches. This obviously reduces the performance of the mattress because the very thick foam layer attenuates the benefits that would otherwise be made available by a full height air mattress, without a foam layer. The expense for the air compressor, control valves, software, and hardware for operating the mattress are essentially fixed, regardless of the height of the air substrate. Thus, the reduced performance of the air substrate using a foam layer directly reduces the overall desirability of the mattress structure.

Accordingly, it is desirable to provide a mattress structure including air cushions that utilize the full height available under the applicable bed siderail regulations, but are resistance to punctures and air loss.

SUMMARY OF THE INVENTION

The present invention provides a mattress for a bed having siderails, including a relatively thin, non-puncture resistant cover having an interior surface, and a core disposed adjacent the interior surface of the cover. The core includes a body that defines a plurality of gas enclosures with self-sealing characteristics. In one embodiment of the invention, the body includes a core that defines the plurality of gas enclosures that function as mounting locations for a plurality of self-sealing gas containers respectively disposed within the plurality of mounting locations. The core may further include an upper layer and a lower layer, connected together at a plurality of substantially parallel seams, thereby forming a plurality of substantially cylindrical mounting locations. The plurality of self-sealing gas containers, in this embodiment, may be formed as substantially cylindrical inflatable tubes, which are respectively disposed in the cylindrical mounting locations. The air containers may be pressurized by a gas source such as an air compressor. In the event of a puncture, the gas containers automatically re-seal as a result of the self-sealing material of the containers, thereby eliminating the need for a foam layer, and avoiding the loss of performance resulting from the use of a protective foam layer.

In another embodiment of the invention, the gas enclosures defined by the core body may include a self-sealing lining. In this embodiment, the core may also include an upper layer and a lower layer, connected together at a plurality of substantially parallel seams, to thereby form the gas enclosures. In the event of a puncture, the gas enclosure lining re-seals the gas enclosure, thereby eliminating the need for a foam layer and the associated loss of performance.

These and other features of the invention will become more apparent, and the invention will be better understood upon review of the following description of embodiments of the invention in conjunction with the accompanying drawings.

DESCRIPTION OF EMBODIMENTS OF THE INVENTION

The embodiments selected for description were not selected to limit the invention to the precise forms disclosed. Instead, the embodiments were selected to illustrate the concepts of the invention and to enable one of ordinary skill in the art to practice the invention.

Figure 1:
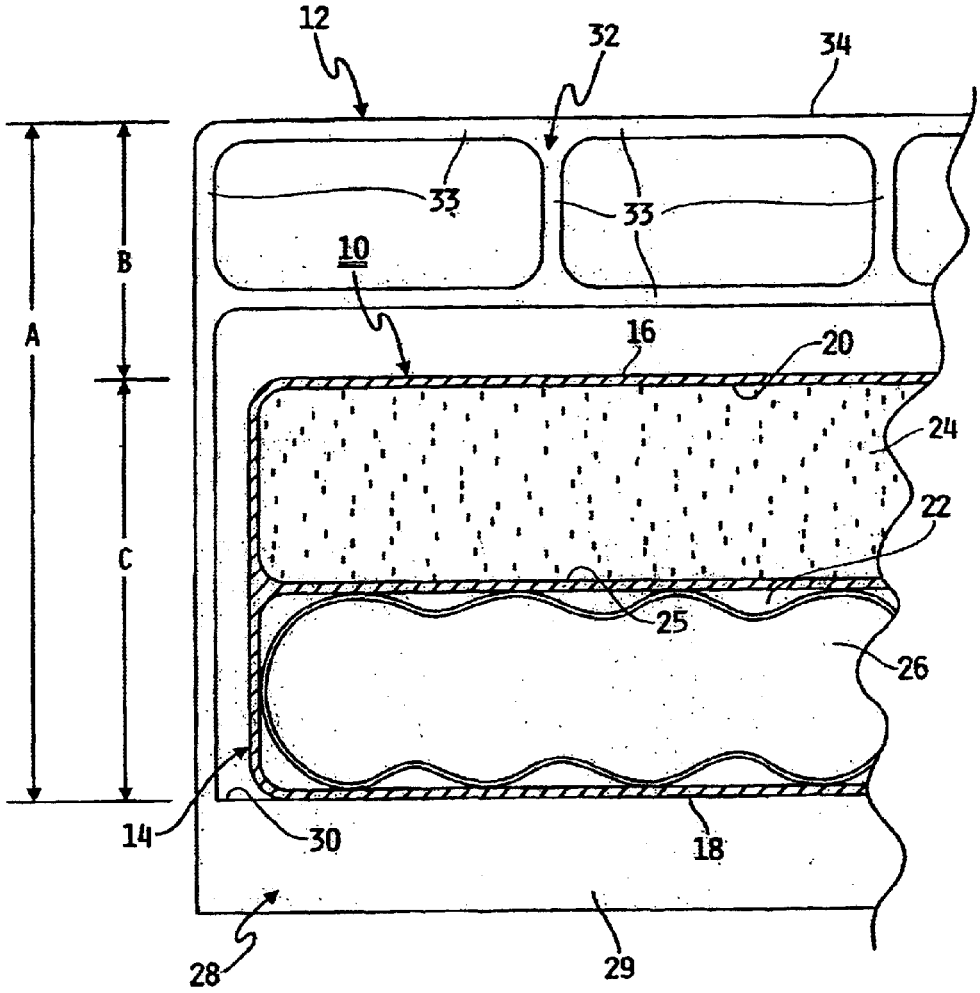
FIG. 1 PRIOR ART
FIG. 1 is a partially fragmented, side elevation view of a prior art mattress structure supported by a hospital bed having siderails.

Referring now to FIG. 1, a conventional mattress structure 10 is shown situated on a conventional hospital bed 12. Mattress structure 10 generally includes an enclosure 14 having an upper, sleep surface 16, a lower surface 18, and defining an upper chamber 20 and a lower chamber 22. Chambers 20, 22 may be divided into a plurality of sub-chambers (not shown) by a plurality of interior walls (not shown). Upper chamber 20 is separated from lower chamber 22 by a dividing wall 25. In conventional mattress structure 10, upper chamber 20 contains a foam layer 24, and lower chamber 22 contains an inflatable layer 26. Foam layer 24 may include a plurality of foam cylinders or other shapes (shown as one solid foam piece in FIG. 1). Similarly, inflatable layer 26 may include a plurality of gas containers, such as inflatable air bladders (shown as one air bladder in FIG. 1).

Bed 12 includes a frame 28 having a support structure 29 including a mattress support surface 30. Frame 28 also includes a siderail 32. Siderail 32 includes a plurality of vertical and horizontal components 33 and an upper edge 34. As shown in FIG. 1, siderail 32 extends from support surface 30 by a distance or height indicated by the letter "A." For a variety of reasons including patient safety, regulatory authorities require health care facilities and other similar organizations that use patient beds to maintain a minimum distance between upper edge 34 of siderail 32 and sleep surface 16 of mattress 10. This minimum distance is indicated by the letter "B." As should be apparent from the foregoing, the maximum height of mattress 10 is thus defined by the difference between distance "A" and distance "B" (indicated in FIG. 1 by the letter "C"). As shown, a relatively large portion of the overall height of conventional mattress structure 10 is occupied by foam layer 24. Thus, in conventional mattress structures, the height available for inflatable layer 26 is greatly reduced by the use of foam layer 24.

Figure 2:
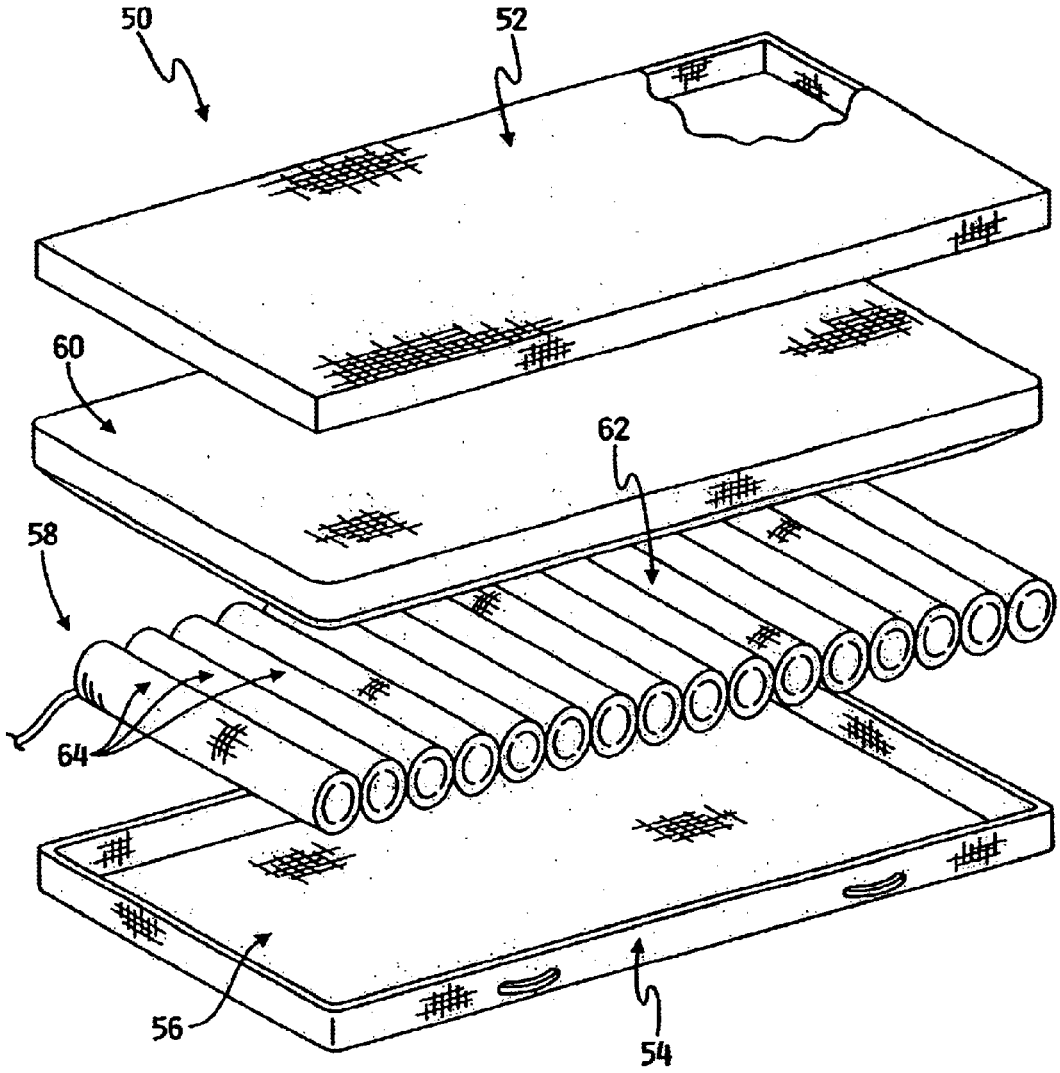
FIG. 2 is a partially fragmented, perspective view of components of a mattress structure according to one embodiment of the present invention.

Referring now to FIG. 2, a mattress structure according to the present invention is shown and generally indicated by the numeral 50. Mattress structure 50 may include a top cover 52 and a bottom cover 54. Top cover 52 and bottom cover 54 may be connected together to define an interior region 56. Additionally, covers 52, 54 may be formed from an impermeable and wipable or cleanable material. It should be noted that top cover 52 does not include a foam layer or puncture prevention layer of any kind. Thus, top layer 52 is non-puncture resistant. As such, top cover 52 may be relatively thin.

Mattress structure 50 further includes a support core 58 and may also include a liner 60 placed over support core 58. Liner 60 may be formed of a shear, low friction material so that top cover 52 slides relatively easily over core 58. Core 58 generally includes a body 62 that defines a plurality of mounting locations 64. As will be further described below, in one embodiment of the invention, mounting locations 64 form enclosures 66 (FIGS. 3 and 4) which respectively receive a plurality of gas containers 68A–D.

Figure 3:
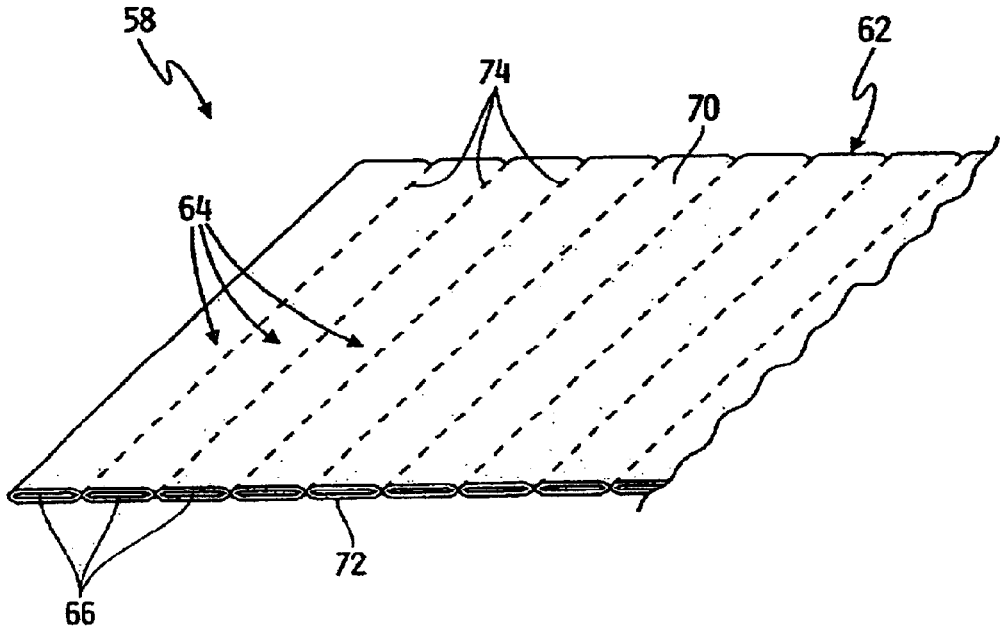
FIG. 3 is a partially fragmented, perspective view of a component of a core body according to the present invention.

Referring now to FIG. 3, body 62 generally includes an upper layer 70 and a lower layer 72. The upper layer 70 is connected to the lower layer 72 by a plurality of seams 74. Seams 74 may be formed, depending upon the materials used for layers 70, 72, using any of a variety of conventional techniques such as sewing, heat welding, etc. As shown in FIG. 3, seams 74 of this embodiment are substantially parallel to one another thereby forming enclosures 66 as a plurality of substantially cylindrical spaces for receiving a plurality of gas containers 68A–D (best shown in FIG. 4). While a variety of different materials may be suitable for forming body 62, in one embodiment of the invention, body 62 is formed preferably of substantially non-stretchable material such as a non-stretch fabric or non-stretch film material. Non-stretch fabric materials may include manmade or natural fibers (or a blend) that are woven, non-woven, or knitted. Non-stretch film materials may include manmade films and manmade, natural, or blended scrim fiber. These materials may be constructed into, for example, scrim reinforced films or non-reinforced films. For example, a woven nylon twill material may be used. The type of material should be sufficiently flexible to permit insertion and removal of gas containers 68A–D, but also able to contain or reinforce gas container 68A–D (which may otherwise flex or expand to a size beyond that defined by enclosures 66) to the dimensions defined by the enclosures 66.

Figure 4:
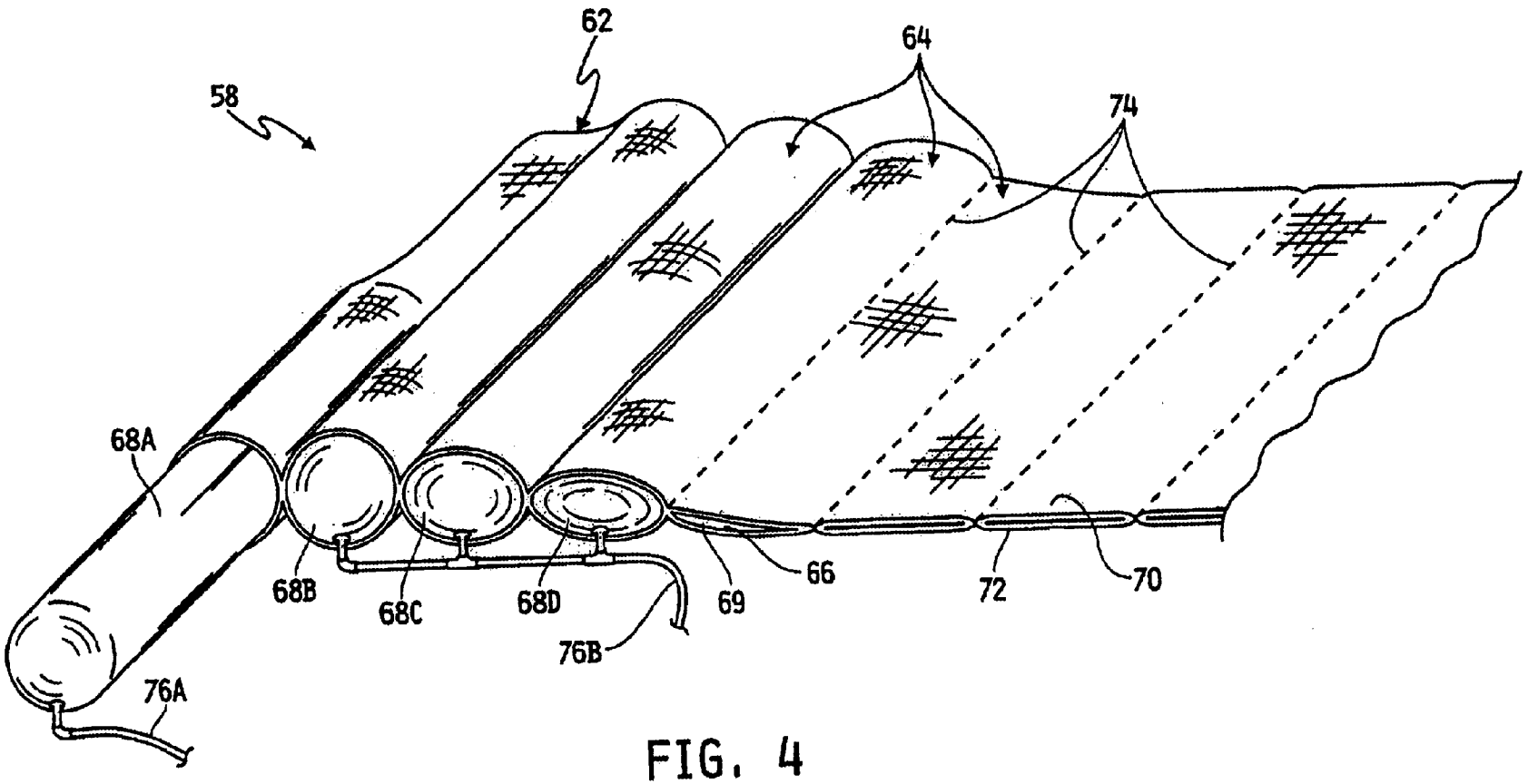
FIG. 4 is a partially fragmented, perspective view of a core body according to one embodiment of the invention.

FIG. 4 shows core 58 in a partially assembled state. As shown, gas containers 68A–D are inserted into enclosures 66 (gas container 68A is shown partially inserted). Additional gas containers 68A–D may be inserted into the remaining enclosures 66 to complete the assembly of core 58. Each gas container 68A–D is, in this embodiment, connected to a gas source (not shown), such as an air compressor or pump. In this example, gas container 68A is connected by plumbing 76A to a gas source. Gas containers 68B–D are connected to one another and to a gas source by plumbing 76B. Thus, as shown in FIG. 4, multiple gas containers may be connected together at various locations along the length of core 58. Each of these groups of gas containers 68A–D may be connected to a separate outlet of the gas source or through use of valves such that they are pressurized independently of the other groups. For example, gas container 68A may be pressurized to a higher pressure, thereby providing a stiffer portion of core 58, while gas containers 68B–D may be pressurized to a lower pressure to provide more cushion or give. Any combination may be accomplished by employing conventional plumbing or tubing. Thus, for example, the head portion of mattress 50 may be made firmer than the upper body portion of mattress 50.

It should be understood that while enclosures 66 and gas containers 68A–D are shown as being substantially cylindrical having an opening at one end, any of a variety of shapes may be used with single or multiple openings to receive gas container 68A–D. For example, core 58 may include a single enclosure 66 that expands the entire length and width of core 58, and encloses a single rectangularly shaped gas container 68. Alternatively, a grid of enclosures may be formed (square, rectangular, round, etc.) for receiving a plurality of similarly shaped gas containers. Moreover, enclosures 66 may be formed diagonally relative to the length and width of core 58 to receive gas containers 68A–D of virtually any shape.

In the embodiment shown in FIG. 4, gas containers 68A–D may be formed from a visco-elastic sheet membrane, or other similar material having a self-sealing property. Such materials typically have a low tensile strength and are highly elastic, and thus may bend and stretch relatively easily. Accordingly, reinforcement is provided to gas containers 68A–D by the external sleeves formed by enclosures 66 at mounting locations 64.

In another embodiment of the invention, enclosures 66 may include self-sealing linings. More specifically, instead of gas containers 68A–D, the interior surfaces of enclosures 66 may be coated with a self-sealing material which renders the enclosure air tight and capable of resealing in the event of a puncture. In this embodiment of the invention, instead of including an opening 69 as shown in FIG. 4, enclosures 66 are formed to receive a gas inlet which is connected through associated plumbing to a gas supply. Enclosure 66 may be plumbed together in groups in the manner described above in relation to gas containers 68B–D of FIG. 4.

The foregoing description of the invention is illustrative only, and is not intended to limit the scope of the invention to the precise terms set forth. Although the invention has been described in detail with reference to certain illustrative embodiments, variations and modifications exist within the scope and spirit of the invention as described and defined in the following claims.

What is claimed is:

1. A mattress for a bed having a frame for supporting the mattress and siderails, including:

a non-puncture resistant cover having an interior surface; and a core disposed adjacent the interior surface including a body defining a plurality of mounting locations, each mounting location including an enclosure, the core further including a plurality of self-sealing gas containers respectively disposed within the plurality of enclosures.

2. The mattress of claim 1, wherein each enclosure provides a substantially cylindrical space for receiving a respective container.

3. The mattress of claim 1, wherein the body is formed of substantially non-stretchable material.

4. The mattress of claim 3, wherein the substantially non-stretchable material is one of substantially non-stretchable fabric and substantially non-stretchable film.

5. The mattress of claim 1, wherein the body is formed of woven nylon twill.

6. The mattress of claim 1, wherein the cover defines an interior space bounded by the interior surface, the core being disposed substantially within the interior space.

7. The mattress of claim 1, wherein the containers are substantially cylindrical.

8. The mattress of claim 1, wherein the body includes an upper layer and a lower layer, the upper and lower layers being connected at a plurality of seams, thereby forming substantially cylindrical spaces for receiving the plurality of containers.

9. The mattress of claim 8 wherein the plurality of seams are substantially parallel to one another.

10. The mattress of claim 1 wherein the containers are connected to a gas source.

11. The mattress of claim 1 wherein the cover includes a sleep surface opposite the interior surface.

12. The mattress of claim 1 wherein the siderails have a minimum height above a sleep surface of the cover, and the core has a height, substantially all of the core height being occupied by the plurality of containers.

13. The mattress of claim 1 wherein one of the containers is pressurized to a first pressure and another of the containers is pressurized to a second pressure that is different from the first pressure.

14. A mattress for a bed having a frame for supporting the mattress and siderails, including:

a non-puncture resistant cover having an interior surface; and a core disposed adjacent the interior surface including a plurality of enclosures, each enclosure including a self-sealing lining and each enclosure being affixed to an adjacent enclosure.

15. The mattress of claim 14 wherein each enclosure defines a substantially cylindrical space.

16. The mattress of claim 14 wherein the cover includes a sleep surface opposite the interior surface.

17. The mattress of claim 16 wherein the siderails have a minimum height above the cover sleep surface, thereby defining a maximum height of the core, substantially all of the maximum core height being occupied by the plurality of enclosures.

18. The mattress of claim 14 wherein the plurality of enclosures are connected to a gas source, the gas source pressurizing the enclosures with a gas.

19. The mattress of claim 18 wherein one of the plurality of enclosures is pressurized to a first pressure and another of the plurality of enclosures is pressurized to a second pressure that is different from the first pressure.

20. The mattress of claim 14 wherein the cover defines an interior space bounded by the interior surface, the core being disposed substantially within the interior space.

21. The mattress of claim 14 wherein the core includes an upper layer and a lower layer, the upper and lower layers being connected at a plurality of seams, thereby forming the plurality of enclosures.

22. The mattress of claim 21 wherein the plurality of seams are substantially parallel to one another.

23. A mattress, including:

means for defining a core including a plurality of sealed enclosures containing a gas, each enclosure being affixed to an adjacent enclosure; and means for automatically re-sealing a puncture in any of the plurality of enclosures to prevent the gas from being released.

24. A patient support including:

a frame, a siderail connected to the frame, and a mattress supported by the frame including a non-puncture resistant cover having an interior surface; and a core disposed adjacent the interior surface including a plurality of enclosures housing a respective plurality of containers, each container including a self-sealing lining.

25. The patient support of claim 24 wherein the plurality of enclosures are connected to a gas source, the gas source pressurizing the enclosures with a gas.

26. The patient support of claim 25 wherein one of the plurality of enclosures is pressurized to a first pressure and another of the plurality of enclosures is pressurized to a second pressure that is different from the first pressure.

27. The patient support of claim 24 wherein the cover includes a sleep surface opposite the interior surface and the core is positioned on an upper surface of the frame.

28. The patient support of claim 27 wherein the siderail has a minimum height above the cover sleep surface, thereby defining a maximum height of the core relative to the upper surface of the frame, substantially all of the maximum core height being occupied by the plurality of enclosures.

29. The patient support of claim 24 wherein each enclosure defines a substantially cylindrical space.

30. The patient support of claim 24 wherein the plurality of enclosures are formed of substantially non-stretchable material.

31. The patient support of claim 30 wherein the substantially non-stretchable material is one of substantially non-stretchable fabric and substantially non-stretchable film.

32. The patient support of claim 24 wherein the plurality of enclosures are formed of woven nylon twill.

33. The patient support of claim 24 wherein the cover defines an interior space bounded by the interior surface, the core being disposed substantially within the interior space.

34. The patient support of claim 24 wherein the core includes an upper layer and a lower layer, the upper and lower layers being connected at a plurality of seams, thereby forming the plurality of enclosures.

35. The patient support of claim 34 wherein the plurality of seams are substantially parallel to one another.

36. A mattress for a bed having a frame for supporting the mattress and siderails, including:

a non-puncture resistant cover having an interior surface; and a core disposed adjacent the interior surface including a plurality of enclosures, each enclosure including a self-sealing lining and each enclosure being affixed to an adjacent enclosure, wherein the plurality of enclosures are formed of substantially non-stretchable material.

37. The mattress of claim 36 wherein the substantially non-stretchable material is one of substantially non-stretchable fabric and substantially non-stretchable film.

38. The mattress of claim 36 wherein the cover includes a sleep surface opposite the interior surface.

39. The mattress of claim 38 wherein the siderails have a minimum height above the cover sleep surface, thereby defining a maximum height of the core, substantially all of the maximum core height being occupied by the plurality of enclosures.

40. The mattress of claim 36 wherein each enclosure defines a substantially cylindrical space.

41. The mattress of claim 36 wherein the cover defines an interior space bounded by the interior surface, the core being disposed substantially within the interior space.

42. The mattress of claim 36 wherein the core includes an upper layer and a lower layer, the upper and lower layers being connected at a plurality of seams, thereby forming the plurality of enclosures.

43. The mattress of claim 42 wherein the plurality of seams are substantially parallel to one another.

44. The mattress of claim 36 wherein the plurality of enclosures are connected to a gas source, the gas source pressurizing the enclosures with a gas.

45. The mattress of claim 44 wherein one of the plurality of enclosures is pressurized to a first pressure and another of the plurality of enclosures is pressurized to a second pressure that is different from the first pressure.

46. A mattress for a bed having a frame for supporting the mattress and siderails, including:

a non-puncture resistant cover having an interior surface; and a core disposed adjacent the interior surface including a plurality of enclosures, each enclosure including a self-sealing lining and each enclosure being affixed to an adjacent enclosure, wherein the plurality of enclosures are formed of woven nylon twill.

47. The mattress of claim 46 wherein the cover defines an interior space bounded by the interior surface, the core being disposed substantially within the interior space.

48. The mattress of claim 46 wherein each enclosure defines a substantially cylindrical space.

49. The mattress of claim 46 wherein the core includes an upper layer and a lower layer, the upper and lower layers being connected at a plurality of seams, thereby forming the plurality of enclosures.

50. The mattress of claim 49 wherein the plurality of seams are substantially parallel to one another.

51. The mattress of claim 46 wherein the plurality of enclosures are connected to a gas source, the gas source pressurizing the enclosures with a gas.

52. The mattress of claim 51 wherein one of the plurality of enclosures is pressurized to a first pressure and another of the plurality of enclosures is pressurized to a second pressure that is different from the first pressure.

53. The mattress of claim 46 wherein the cover includes a sleep surface opposite the interior surface.

54. The mattress of claim 53 wherein the siderails have a minimum height above the cover sleep surface, thereby defining a maximum height of the core, substantially all of the maximum core height being occupied by the plurality of enclosures.

55. A mattress for a bed having a frame for supporting the mattress and siderails, including:

a non-puncture resistant, substantially non-cushioning member having an interior surface; and a core disposed adjacent the interior surface of the substantially non-cushioning member, the core including a plurality of self-sealing gas containers and a body, the body including a plurality of enclosures, the plurality of self-sealing gas containers respectively disposed within the plurality of enclosures.

56. The mattress of claim 55 wherein one of the containers is pressurized to a first pressure and another of the containers is pressurized to a second pressure that is different from the first pressure.

57. The mattress of claim 55 wherein the substantially non-cushioning member includes an impermeable material.

58. The mattress of claim 55 wherein each enclosure provides a substantially cylindrical space for receiving a respective container.

59. The mattress of claim 55 wherein the body is formed of substantially non-stretchable material.

60. The mattress of claim 59 wherein the substantially non-stretchable material is one of substantially non-stretchable fabric and substantially non-stretchable film.

61. The mattress of claim 55 wherein the body is formed of woven nylon twill.

62. The mattress of claim 55 wherein the substantially non-cushioning member defines an interior space bounded by the interior surface, the core being disposed substantially within the interior space.

63. The mattress of claim 55 wherein the containers are substantially cylindrical.

64. The mattress of claim 55 wherein the containers are connected to a gas source.

65. The mattress of claim 55 wherein the substantially non-cushioning member includes a sleep surface opposite the interior surface.

66. A mattress for a bed having a frame for supporting the mattress and siderails, including:

a non-puncture resistant, substantially non-cushioning member having an interior surface; and a core disposed adjacent the interior surface including a plurality of enclosures, each enclosure including a self-sealing lining and each enclosure being affixed to an adjacent enclosure.

67. The mattress of claim 66 wherein one of the enclosures is pressurized to a first pressure and another of the enclosures is pressurized to a second pressure that is different from the first pressure.

68. The mattress of claim 66 wherein the substantially non-cushioning member includes an impermeable material.

69. The mattress of claim 66 wherein the substantially non-cushioning member defines an interior space bounded by the interior surface, the core being disposed substantially within the interior space.

70. The mattress of claim 66 wherein the core is connected to a gas source.

71. The mattress of claim 66 wherein the substantially non-cushioning member includes a sleep surface opposite the interior surface.

72. A patient support including:

a frame;

a siderail connected to the frame; and a mattress supported by the frame, the mattress including:

a first member defining an interior region and having a top surface and a first height, the top surface including a non-puncture resistant portion; and a core disposed within the first member adjacent the top surface, the core including a plurality of self-sealing inflatable members, each of the inflatable members configured to be inflated with a fluid, wherein a height of the core is substantially equal to the first interior height when the plurality of inflatable members are inflated with the fluid.

73. The patient support of claim 72 wherein the first member of the mattress includes a top cover and a bottom cover, the top cover and the bottom cover being connected together to define the interior region.

74. The patient support of claim 72 wherein the non-puncture resistant portion is substantially non-cushioning.

75. The patient support of claim 72 wherein the core of the mattress includes a body including a plurality of enclosures.

76. The patient support of claim 75 wherein the plurality of inflatable members are gas containers respectively disposed within the plurality of enclosures.

77. The patient support of claim 75 wherein each of the plurality of enclosures includes a self-sealing lining to form the plurality of inflatable members.

* * * * *